US010492985B2

(12) United States Patent
Golan

(10) Patent No.: US 10,492,985 B2
(45) Date of Patent: Dec. 3, 2019

(54) MASSAGE SHOES

(75) Inventor: Yaffa Golan, Tel Aviv (IL)

(73) Assignee: Yaffa Golan, Tel Aviv (IL)

( * ) Notice: Subject to any disclaimer, the term of this patent is extended or adjusted under 35 U.S.C. 154(b) by 586 days.

(21) Appl. No.: 13/979,493

(22) PCT Filed: Jan. 5, 2012

(86) PCT No.: PCT/IL2012/000004
§ 371 (c)(1),
(2), (4) Date: Jul. 12, 2013

(87) PCT Pub. No.: WO2012/101625
PCT Pub. Date: Aug. 2, 2012

(65) Prior Publication Data

US 2013/0303952 A1 Nov. 14, 2013

Related U.S. Application Data

(60) Provisional application No. 61/435,884, filed on Jan. 25, 2011.

(51) Int. Cl.
*A61H 23/00* (2006.01)
*A61H 23/02* (2006.01)
*A43B 7/14* (2006.01)

(52) U.S. Cl.
CPC ..... *A61H 23/02* (2013.01); *A43B 7/146* (2013.01); *A61H 23/0263* (2013.01);
(Continued)

(58) Field of Classification Search
CPC ..... A61H 1/00; A61H 1/008; A61H 1/0266; A61H 23/00; A61H 23/004; A61H 23/006; A61H 23/02; A61H 23/0254; A61H 23/0263; A61H 2201/00; A61H 2201/0157; A61H 2201/12; A61H 2201/1207; A61H 2201/1215; A61H 2201/164; A61H 2201/1642; A61H 2203/0406; A61H 2205/00; A61H 2205/12; A61H 2205/125
See application file for complete search history.

(56) References Cited

U.S. PATENT DOCUMENTS 3,888,242 A * 6/1975 Harris ..... A61H 9/0078 36/141
5,113,850 A 5/1992 Larremore
(Continued)

FOREIGN PATENT DOCUMENTS

JP 0736703 7/1995
WO 2012/101625 A2 8/2012

OTHER PUBLICATIONS

U.S. Appl. No. 61/435,884, filed Jan. 25, 2011.
(Continued)

*Primary Examiner* — Steven O Douglas
(74) *Attorney, Agent, or Firm* — Sughrue Mion, PLLC

(57) ABSTRACT

A massaging shoe including a shoe body portion formed of a vibration transmitting material and having an interior surface which includes a multiplicity of integrally formed raised surface elements and a vibrator operative to generate vibrations, the vibrations being transmitted via the vibration transmitting material and the integrally formed raised surface elements to a foot of a wearer of the shoe.

2 Claims, 2 Drawing Sheets

(52) U.S. Cl.
CPC ..... *A61H 2023/0272* (2013.01); *A61H 2201/165* (2013.01); *A61H 2201/1642* (2013.01); *A61H 2201/1695* (2013.01); *A61H 2205/12* (2013.01)

(56) References Cited

U.S. PATENT DOCUMENTS

| | | | | |
|---|---|---|---|---|
| 6,464,654 | B1 | 10/2002 | Montgomery | |
| D480,540 | S | 10/2003 | Hoyt et al. | |
| 7,264,599 | B1 * | 9/2007 | Milligan | A43B 3/0005 36/141 |
| 7,347,831 | B2 | 3/2008 | Chiu | |
| 7,614,168 | B1 * | 11/2009 | Zummer | A61H 15/0078 36/141 |
| 7,640,681 | B2 | 1/2010 | Yang et al. | |
| D626,728 | S | 11/2010 | Tzenos et al. | |
| D630,006 | S | 1/2011 | Voare et al. | |
| D648,105 | S | 11/2011 | Schlageter et al. | |
| D648,512 | S | 11/2011 | Schlageter et al. | |
| D686,807 | S | 7/2013 | Tzenos | |
| 2008/0005936 | A1 | 1/2008 | Chiu | |
| 2008/0161734 | A1 | 7/2008 | Blockton | |
| 2009/0193680 | A1 | 8/2009 | Pang | |
| 2012/0186101 | A1 * | 7/2012 | Sanchez | A43B 3/0005 36/44 |

OTHER PUBLICATIONS

An International Search Report and a Written Opinion both dated May 16, 2012, which issued during the prosecution of Applicant's PCT/IL2012/000004.

An International Preliminary Report on Patentability dated Sep. 3, 2013, which issued during the prosecution of Applicant's PCT/IL2012/000004.

An Office Action dated May 29, 2015, which issued during the prosecution of New Zealand Patent Application No. 614550.

An Office Action dated Jul. 15, 2015, which issued during the prosecution of Australian Patent Application No. 2012210166.

Supplementary European Search Report dated Mar. 23, 2015, which issued during the prosecution of Applicant's European App No. 12738977.

An Office Action dated Sep. 20, 2018, which issued during the prosecution of Design U.S. Appl. No. 29/480,619.

* cited by examiner

MASSAGE SHOES

CROSS REFERENCE TO RELATED APPLICATIONS

This is a National Stage of International Application No. PCT/IL2012/000004 filed Jan. 5, 2012, claiming priority based on U.S. Provisional Patent Application No. 61/435,884 filed Jan. 25, 2011, the contents of all of which are incorporated herein by reference in their entirety.

FIELD OF THE INVENTION

The present invention relates to massaging shoes systems.

BACKGROUND OF THE INVENTION

The following patent publications are believed to represent the current state of the art:

U.S. Pat. Nos. 5,113,850 and 6,464,654.

SUMMARY OF THE INVENTION

The present invention provides massaging shoes and massaging shoe systems.

There is thus provided in accordance with a preferred embodiment of the present invention a massaging shoe including a shoe body portion formed of a vibration transmitting material and having an interior surface which includes a multiplicity of integrally formed raised surface elements and a vibrator operative to generate vibrations, the vibrations being transmitted via the vibration transmitting material and the integrally formed raised surface elements to a foot of a wearer of the shoe.

In accordance with a preferred embodiment of the present invention the shoe also includes a massaging control system operative to control the vibrator of the at least one massaging shoe. Preferably, the vibration transmitting material is an elastomeric material. Preferably, the vibrator includes an internal power source and an integral motor mechanism operative to generate the vibrations.

Preferably, the interior surface includes surface portions which engage the sides and top of the foot of the wearer of the shoe. Preferably, the interior surface also includes a bottom surface portion which engages the underside of the foot of the wearer of the shoe. Alternatively, the integrally formed raised surface elements are also formed on a shoe insert which is inserted into the shoe.

Preferably, the shoe also includes at least one elastic gore. Additionally, the shoe also includes at least one fastening strap. Preferably, the shoe also includes an electrical connection operable for connecting the shoe to an external power source. Preferably, the internal power source is a chargeable power source. Preferably, the chargeable power source is a battery. Preferably, the integral motor mechanism includes an integrated circuit operative to control the integral motor mechanism.

Preferably, the integral motor mechanism also includes at least two discrete eccentric drive motors, each of the motors operable to generate vibrations which are transmitted throughout respective forward and rearward parts of the shoe. Preferably, the integral motor mechanism also includes two drive motor casings for encasing the eccentric drive motors. Preferably, the casings are operative to acoustically insulate the drive motors.

In accordance with a preferred embodiment of the present invention the combination of the vibration transmitting material and the two discrete eccentric drive motors are together operative to achieve generally homogeneous dispersion of the vibrations throughout the shoe to the multiplicity of integrally formed raised surface elements.

There is also provided in accordance with another preferred embodiment of the present invention a foot massaging system including at least one massaging shoe, the shoe including a shoe body portion formed of a vibration transmitting material and having an interior surface which includes a multiplicity of integrally formed raised surface elements and a vibrator operative to generate vibrations, the vibrations being transmitted via the vibration transmitting material and the integrally formed raised surface elements to a foot of a wearer of the shoe, and a massaging control system operative to control the vibrator of the shoe.

In accordance with a preferred embodiment of the present invention the shoe also includes a massaging control subsystem operative to control the vibrator of the at least one massaging shoe. Preferably, the system also includes a battery-powered remote control device operable for controlling the massaging control subsystem of the at least one massaging shoe. Preferably, the remote control device is operable to configure the massaging control subsystem of the at least one massaging shoe to operate the vibrator at one of several operating speeds, and to operate the vibrator for the duration of a selectable time period.

Preferably, the vibration transmitting material is an elastomeric material. Preferably, the vibrator includes an internal power source and an integral motor mechanism operative to generate the vibrations.

Preferably, the interior surface includes surface portions which engage the sides and top of the foot of the wearer of the shoe. Preferably, the interior surface also includes a bottom surface portion which engages the underside of the foot of the wearer of the shoe. Alternatively, the integrally formed raised surface elements are also formed on a shoe insert which is inserted into the shoe.

Preferably, the shoe also includes at least one elastic gore. Preferably, the shoe also includes at least one fastening strap. Preferably, the shoe also includes an electrical connection operable for connecting the shoe to an external power source. Preferably, the internal power source is a chargeable power source. Preferably, the chargeable power source is a battery.

Preferably, the integral motor mechanism includes an integrated circuit operative to control the integral motor mechanism. Preferably, the integral motor mechanism also includes at least two discrete eccentric drive motors, each of the motors operable to generate vibrations which are transmitted throughout respective forward and rearward parts of the shoe. Preferably, the integral motor mechanism also includes two drive motor casings for encasing the eccentric drive motors. Preferably, the casings are operative to acoustically insulate the drive motors.

In accordance with a preferred embodiment of the present invention the combination of the vibration transmitting material and the two discrete eccentric drive motors are together operative to achieve generally homogeneous dispersion of the vibrations throughout the shoe to the multiplicity of integrally formed raised surface elements.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
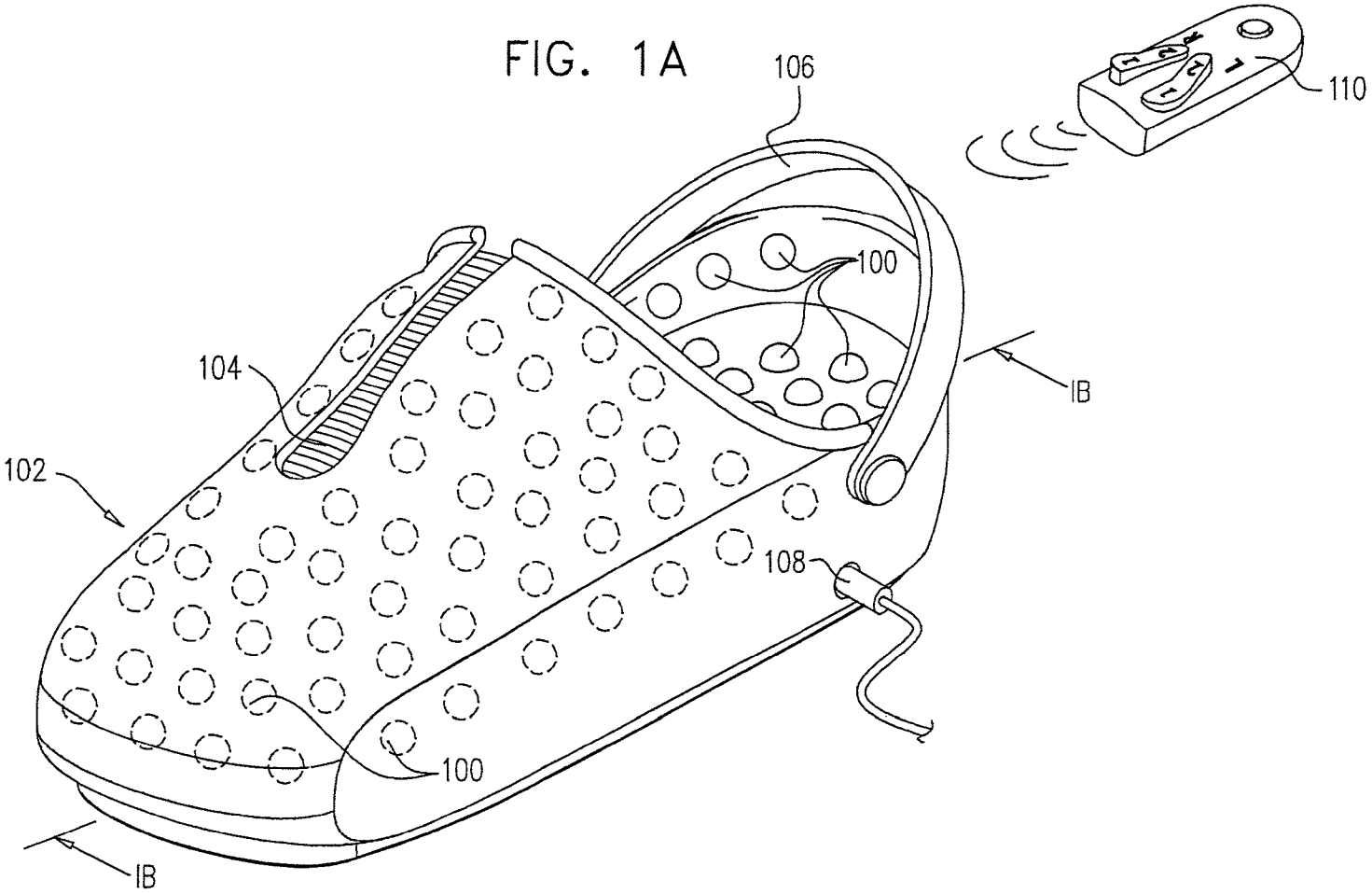
FIG. 1A is a simplified illustration of a pair of foot massaging system constructed and operative in accordance with a preferred embodiment of the present invention.
Figure 1B:
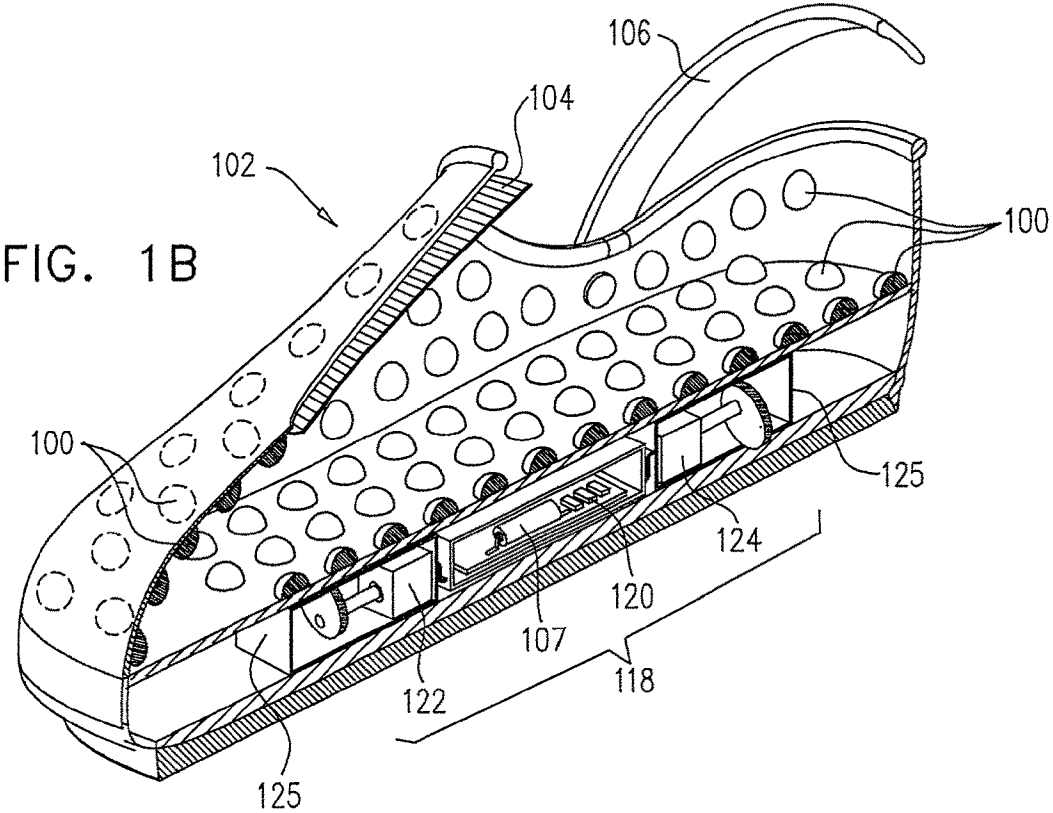
FIG. 1B is a simplified sectional illustration of the interior structure of the massage shoe of FIG. 1A, taken along lines IB-IB in FIG. 1A.

Reference is now made to FIG. 1A, which is a simplified illustration of a foot massaging system constructed and operative in accordance with a preferred embodiment of the present invention, and to FIG. 1B, which is a simplified sectional illustration of the interior structure of the massage shoe of FIG. 1A, taken along lines IB-IB in FIG. 1A.

The foot massaging system of FIGS. 1A & 1B preferably includes at least one massaging shoe, the shoe including a shoe body portion formed of a vibration transmitting material and having an interior surface which includes a multiplicity of integrally formed raised surface elements, and a vibrator operative to generate vibrations. The vibrations are preferably transmitted via the vibration transmitting material and the integrally formed raised surface elements to a foot of a wearer of the shoe, thereby providing a massaging sensation to the foot of the wearer of the shoe. The shoe preferably also includes a massaging control system operative to control the vibrator of the shoe.

The vibration transmitting material is preferably an elastomeric material such as ethylene-vinyl acetate. The vibrator preferably includes a power source and an integral motor mechanism which generates the vibrations.

As shown in FIG. 1A, a multiplicity of preferably integrally formed raised surface elements 100 are preferably dispersed over the entire interior surface of a massage shoe 102, including the portions engaging the underside, sides and top of the wearer's foot. Alternatively, the raised surface elements 100 engaging the underside of the wearer's foot may be integrally formed on a shoe insert which is inserted into shoe 102.

Preferably, an elastic gore 104 is formed in the top surface of shoe 102 and provides for snug fitting of shoe 102 to a wearer's foot. Additionally, a fastening strap 106 is preferably provided for further fastening of shoe 102 to the wearer's foot.

A chargeable power source 107 (FIG. 1B), such as a battery, is preferably integrally provided for powering shoe 102. Preferably, an electrical connection 108 is provided for connecting chargeable power source 107 to an external power source, thereby enabling charging thereof.

Preferably, a battery-powered remote control device 110 is provided for controlling the motor mechanism of each of a pair of shoes 102. Preferably, remote control device 110 can be used to set the motor mechanism of each of a pair of shoes 102 to operate at one of several operating speeds, and to operate for the duration of a selectable time period.

Turning now to FIG. 1B, it is shown that a motor mechanism 118 operative to generate vibrations is embedded within the sole of shoe 102. Motor mechanism 118 preferably includes an integrated circuit 120 for receiving control inputs from remote control device 110 operative to control motor mechanism 118. Motor mechanism 118 includes two discrete eccentric drive motors 122 and 124 which each provide vibrations that are transmitted throughout the forward and rearward parts of shoe 102, respectively. Drive motor casings 125 are provided for encasing drive motors 122 and 124, and to thereby acoustically insulate drive motors 122 and 124. Chargeable battery 107 chargeable via electrical connection 108 (FIG. 1A) provides power to integrated circuit 120 and to motors 122 and 124.

It is a particular feature of the present invention that the combination of the vibration transmitting properties of the elastomeric material and the two discrete eccentric drive motors 122 and 124 together achieve generally homogeneous dispersion of vibrations throughout massage shoe 102 to the multiplicity of integrally formed raised surface elements 100, thereby providing a massaging sensation to the foot of the wearer of shoe 102, not only to the underside of the foot, but also to the side and top portions of the wearer's foot. It is another particular feature of the present invention that the generally homogeneous dispersion of vibrations throughout massage shoe 102 to the multiplicity of integrally formed raised surface elements 100 is operative to improve blood circulation in the wearer's foot.

It will be appreciated by persons skilled in the art that the present invention is not limited by what has been particularly shown and described hereinabove. Rather, the invention also includes various combinations and subcombinations of the features described hereinabove as well as modifications and variations thereof, which would occur to persons skilled in the art upon reading the foregoing and which are not in the prior art.

The invention claimed is:

1. A foot massaging system comprising:

at least one massaging shoe, said shoe comprising:

a shoe body portion formed of a vibration transmitting material and having an interior surface which comprises a multiplicity of integrally formed raised surface elements, said multiplicity of integrally formed raised surface elements being formed on interior portions adapted to engage the underside, sides and top of a foot of a wearer of said at least one massaging shoe;

at least one vibrator operative to generate vibrations, said vibrations being transmitted via said vibration transmitting material and said integrally formed raised surface elements to said underside, sides and top of said foot of said wearer of said at least one massaging shoe, said vibration transmitting material being an elastomeric material including ethylene-vinyl acetate, said at least one vibrator including:

a chargeable battery;

an electrical connection operable for connecting said chargeable battery to an external power source; and an integral motor mechanism powered by said chargeable power source, said integral motor mechanism operative to generate said vibrations, said integral motor mechanism comprising:

at least two discrete eccentric drive motors, each of said at least two discrete eccentric motors operable for generating vibrations which are transmitted throughout respective forward and rearward parts of said at least one messaging shoe; and at least two drive motor casings for encasing said at least two discrete eccentric drive motors, said casings being operative to acoustically insulate said drive motors;

an elastic gore formed in a top surface of said at least one messaging shoe operative to provide snug fitting of said at least one messaging shoe on said foot of said wearer;

a fastening strap; and a massaging control system operative to control said at least one vibrator of said at least one massaging shoe, said messaging control system comprising an integrated circuit; and a battery-powered remote control device operable for controlling said massaging control system of said at least one massaging shoe, said remote control device being operable for configuring said massaging control system of said at least one massaging shoe to operate said at least one vibrator at one of several operating speeds and to operate said at least one vibrator for the duration of a selectable time period, said integrated circuit receiving control inputs from said remote control device for controlling said integral motor mechanism, said chargeable battery operative to provide power to said integrated circuit and to said at least two discrete eccentric drive motors.

2. A foot massaging system according to claim 1 and wherein the combination of said vibration transmitting material and said at least two discrete eccentric drive motors are together operative to achieve generally homogeneous dispersion of said vibrations throughout said shoe to said multiplicity of integrally formed raised surface elements.

* * * * *